US011022151B2

(12) United States Patent
Iizumi et al.

(10) Patent No.: US 11,022,151 B2
(45) Date of Patent: Jun. 1, 2021

(54) HYDRAULIC DEVICE AND CONTROL METHOD OF HYDRAULIC DEVICE

(71) Applicant: SHIMADZU CORPORATION, Kyoto (JP)

(72) Inventors: Hitomi Iizumi, Nagaokakyo (JP); Kenichi Kanatani, Kyoto (JP); Hiroyuki Nishida, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 16/790,706

(22) Filed: Feb. 13, 2020

(65) Prior Publication Data

US 2020/0271134 A1 Aug. 27, 2020

(30) Foreign Application Priority Data

Feb. 25, 2019 (JP) ..... JP2019-031629

(51) Int. Cl.
*F15B 1/033* (2006.01)

(52) U.S. Cl.
CPC ..... *F15B 1/033* (2013.01); *F15B 2211/20515* (2013.01); *F15B 2211/41563* (2013.01); *F15B 2211/45* (2013.01); *F15B 2211/851* (2013.01); *F15B 2211/853* (2013.01)

(58) Field of Classification Search
CPC ..... F15B 2211/41563; F15B 2211/426; F15B 2211/45; F15B 11/0406; F15B 2211/20515
See application file for complete search history.

(56) References Cited

U.S. PATENT DOCUMENTS 6,029,448 A * 2/2000 Hobson ..... B66F 7/16 417/371
6,065,386 A * 5/2000 Rub ..... F15B 11/028 91/31

(Continued)

FOREIGN PATENT DOCUMENTS

DE 20019448 2/2001
JP 2007223419 9/2007
JP 2018123833 A * 8/2018

OTHER PUBLICATIONS

"Office Action of German Counterpart Application" with English translation thereof, dated Jan. 8, 2021, p. 1-12.

*Primary Examiner* — Thomas E Lazo
(74) *Attorney, Agent, or Firm* — JCIPRNET

(57) ABSTRACT

A hydraulic device is provided. Working fluid stored in a fluid storage portion is supplied by a fluid supply portion to a power output portion. The fluid supply portion is driven by a brushless motor. A bypass flow path portion can be switched between a first state of supplying the working fluid from the fluid supply portion to the fluid storage portion and a second state of blocking the fluid supply portion from the fluid storage portion. A control to switch the bypass flow path portion from the first state to the second state after the brushless motor is started and a control to switch the bypass flow path portion from the second state to the first state when the brushless motor is stopped is performed. Backflow of the working fluid from the power output portion to the bypass flow path portion is prevented by a backflow prevention valve.

10 Claims, 4 Drawing Sheets

(56) References Cited

U.S. PATENT DOCUMENTS

| | | | | |
|---|---|---|---|---|
| 8,776,513 | B2 * | 7/2014 | Nishioka | F15B 11/0423 60/478 |
| 9,541,101 | B2 * | 1/2017 | Aneder | F16H 61/4078 |
| 9,845,812 | B2 * | 12/2017 | Kraibuhler | F15B 21/008 |
| 2004/0079076 | A1 * | 4/2004 | Lazaro | F15B 11/044 60/477 |
| 2017/0313153 | A1 * | 11/2017 | Masamura | B60G 17/056 |

* cited by examiner

HYDRAULIC DEVICE AND CONTROL METHOD OF HYDRAULIC DEVICE

CROSS REFERENCE TO RELATED APPLICATION

This application claims the priority benefit of Japan Application No. 2019-031629, filed on Feb. 25, 2019. The entirety of the above-mentioned patent application is hereby incorporated by reference herein and made a part of this specification.

BACKGROUND OF THE DISCLOSURE

Technical Field

The disclosure relates to a hydraulic device and a control method of hydraulic device.

Related Art

In a working machine such as a truck or the like, a hydraulic device for driving a support arm by hydraulic pressure is arranged. For example, in paten literature 1, a hydraulic device which includes a hydraulic cylinder, a pump and an electric motor is described. In this hydraulic device, in response to a user of the working machine operating a remote controller, the electric motor drives the pump. Thereby, the pump supplies working liquid to the hydraulic cylinder which actuates a support arm of a load receiving platform.

In the hydraulic device, generally a DC (direct current) brush motor is used as the electric motor. However, a period of endurance of the brush motor is limited by life of a brush, and thus durability of the hydraulic device using the brush motor is not high. Therefore, in recent years, improvement of the durability of the hydraulic device is required.

LITERATURE OF RELATED ART

Patent Literature

[Patent literature 1] Japanese Laid-open No. 2007-223419

It is considered that durability of a hydraulic device can be improved by using a brushless motor instead of the brush motor as an electric motor. However, if the brushless motor is used to configure the hydraulic device, problems such as failure of start due to insufficient torque, pressurization in a pipe or the like may occur. Therefore, the hydraulic device cannot be operated with high reliability in some cases. Here, the pressurization means a state in which pressure inside the pipe increases when the brushless motor is stopped.

SUMMARY

An embodiment of an aspect according to the disclosure relates to a hydraulic device including: a fluid storage portion which stores working fluid; a power output portion which outputs power from the working fluid; a fluid supply portion which supplies the working fluid stored in the fluid storage portion to the power output portion; a brushless motor which drives the fluid supply portion; a bypass flow path portion which can be switched between a first state of supplying the working fluid from the fluid supply portion to the fluid storage portion and a second state of blocking the fluid supply portion from the fluid storage portion; a backflow prevention valve which prevents backflow of the working fluid from the power output portion to the bypass flow path portion; and a control portion which performs at least one of a control to switch the bypass flow path portion from the first state to the second state after the brushless motor is started and a control to switch the bypass flow path portion from the second state to the first state when the brushless motor is stopped.

An embodiment of another aspect according to the disclosure relates to a control method of hydraulic device including: a step in which working fluid stored in a fluid storage portion is supplied by a fluid supply portion to a power output portion which outputs power from the working fluid; a step in which the fluid supply portion is driven by a brushless motor; a step in which backflow of the working fluid from the power output portion to a bypass flow path portion is prevented by a backflow prevention valve; and a step in which the bypass flow path portion is switched between a first state of supplying the working fluid from the fluid supply portion to the fluid storage portion and a second state of blocking the fluid supply portion from the fluid storage portion. The step in which the bypass flow path portion is switched includes at least one of switching the bypass flow path portion from the first state to the second state after the brushless motor is started and switching the bypass flow path portion from the second state to the first state when the brushless motor is stopped.

DESCRIPTION OF THE EMBODIMENTS

The embodiments of the disclosure provide a hydraulic device which can be operated with high reliability while durability is improved.

According to the embodiments of the disclosure, the hydraulic device can be operated with high reliability while the durability of the hydraulic device is improved.

(1) Configuration of Hydraulic Device

Figure 1:
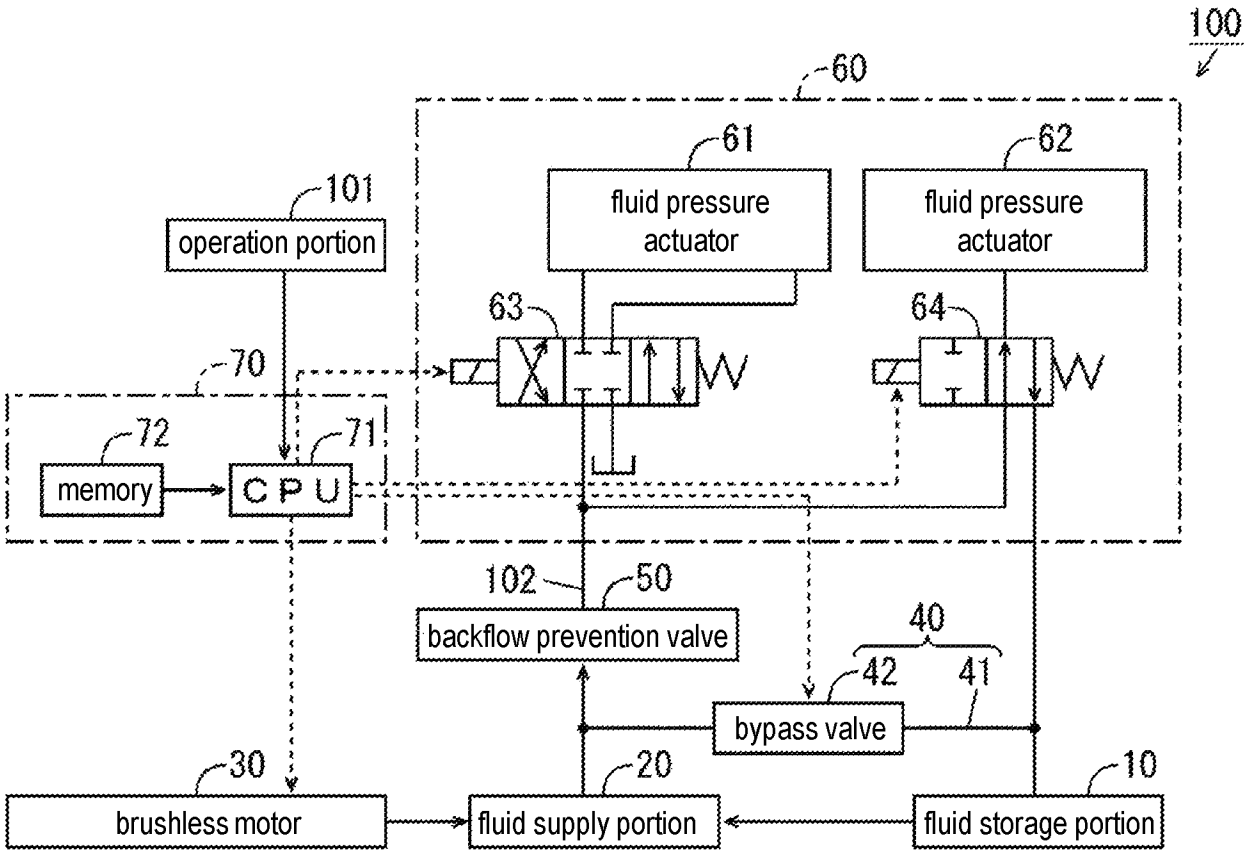
FIG. 1 is a diagram showing a configuration of a hydraulic device according to one embodiment of the disclosure.

A hydraulic device and a control method of hydraulic device according to one embodiment of the disclosure are described with reference to the drawings. In the embodiment, the hydraulic device is arranged in a working machine such as a truck or the like, but the embodiment is not limited hereto, and the hydraulic device may be arranged in other machines. FIG. 1 is a diagram showing a configuration of the hydraulic device according to one embodiment of the disclosure. As shown in FIG. 1, a hydraulic device 100 includes a fluid storage portion 10, a fluid supply portion 20, a brushless motor 30, a bypass flow path portion 40, a backflow prevention valve 50, a power output portion 60 and a control portion 70.

The fluid storage portion 10 is a tank for example, and stores working fluid (hereinafter, simply referred to as the fluid) such as oil or the like. The fluid supply portion 20 is a pump for example, and pumps the fluid stored in the fluid storage portion 10 toward the power output portion 60. The brushless motor 30 drives the fluid supply portion 20. In the embodiment, the brushless motor 30 is a sensorless-type brushless motor and has no position sensor such as a Hall sensor or the like. The embodiment is not limited hereto, and the brushless motor 30 may be a brushless motor with a sensor.

The bypass flow path portion 40 includes a bypass pipe 41 and a bypass valve 42. The bypass pipe 41 is connected between the fluid storage portion 10 and the fluid supply portion 20 so as to return the fluid pumped by the fluid supply portion 20 to the fluid storage portion 10. The bypass valve 42 is inserted into the bypass pipe 41 and can be switched between an opening state of opening the bypass pipe 41 and a blocking state of blocking the bypass pipe 41. The backflow prevention valve 50 is inserted between the fluid supply portion 20 and the bypass flow path portion 40 and the power output portion 60, and prevents the fluid from the power output portion 60 from flowing back into the bypass flow path portion 40.

The power output portion 60 outputs power from the fluid to, for example, a support arm of a load receiving platform. Specifically, the power output portion 60 includes fluid pressure actuators 61 and 62 and direction control valves 63 and 64. In this example, the fluid pressure actuator 61 is a double-acting tilt cylinder which operates due to the fluid pressure and is used to tilt the support arm of the load receiving platform. The direction control valve 63 is arranged between the fluid pressure actuator 61 and the fluid storage portion 10 and the backflow prevention valve 50, and controls the operation of the fluid pressure actuator 61.

In this example, the fluid pressure actuator 62 is a single-acting lift cylinder which operates due to the fluid pressure and is used to raise and lower the support arm of the load receiving platform. The direction control valve 64 is arranged between the fluid pressure actuator 62 and the fluid storage portion 10 and the backflow prevention valve 50, and controls the operation of the fluid pressure actuator 62. A user can command the operation of the fluid pressure actuators 61 and 62 by operating an operation portion 101 such as a remote controller or the like.

The control portion 70 is an ECU (electronic control unit), and includes a CPU (central processing unit) 71 and a memory 72. The CPU 71 controls the operations of the brushless motor 30, the bypass valve 42 and the direction control valves 63 and 64 based on a command from the operation portion 101. A hydraulic device control program for controlling the operation of the CPU 71 is stored in the memory 72. A specific configuration of the control portion 70 is described below.

(2) Control Portion

Figure 2:
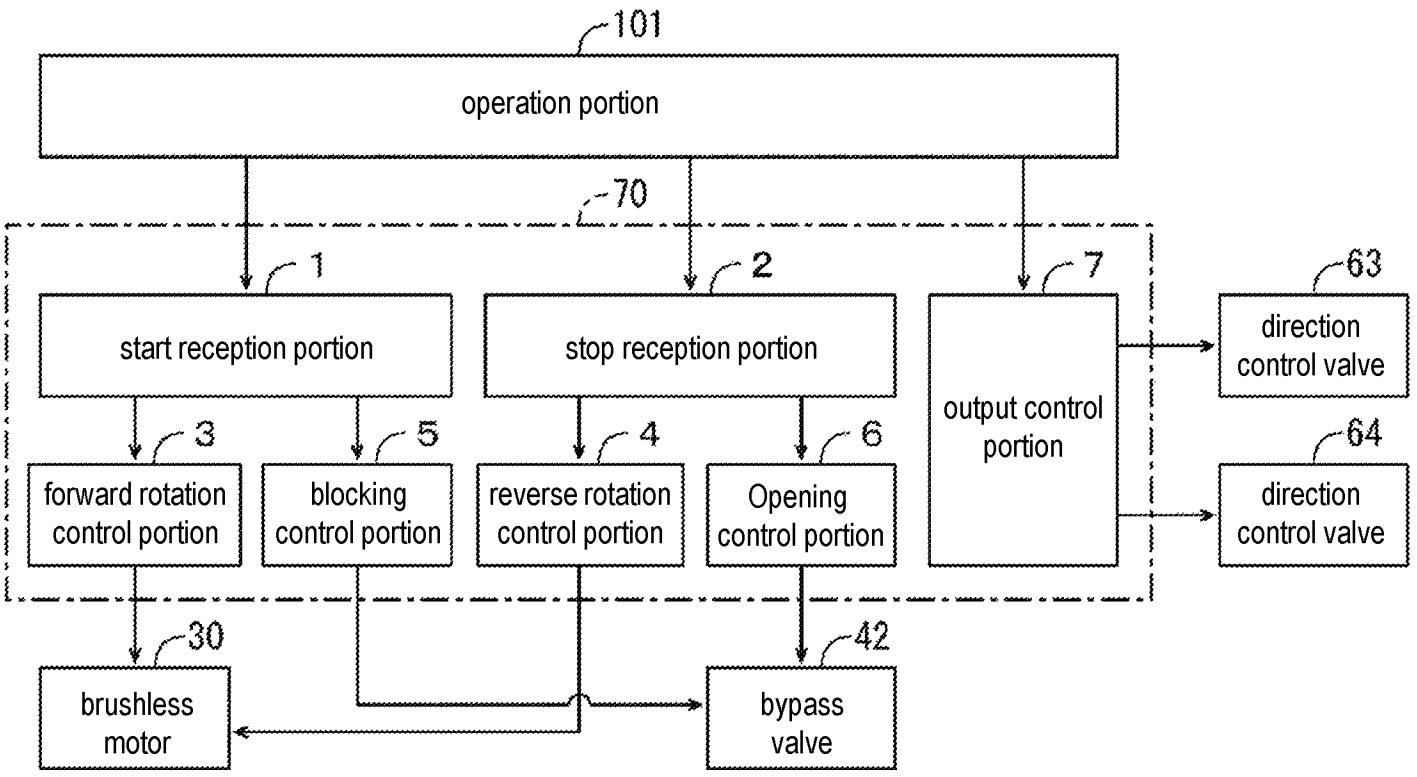
FIG. 2 is a block diagram showing a configuration of a control portion in FIG. 1.

FIG. 2 is a block diagram showing the configuration of the control portion 70 in FIG. 1. As shown in FIG. 2, the control portion 70 includes, as function portions, a start reception portion 1, a stop reception portion 2, a forward rotation control portion 3, a reverse rotation control portion 4, a blocking control portion 5, an opening control portion 6, and an output control portion 7. The CPU 71 in FIG. 1 executes the hydraulic device control program stored in the memory 72, and thereby the function portions of the control portion 70 are implemented. A part of or all of the function portions of the control portion 70 may be implemented by hardware such as an electronic circuit or the like.

The start reception portion 1 receives, from the operation portion 101, a command (hereinafter, referred to as the start command) for starting any one of the fluid pressure actuators 61 and 62 in FIG. 1. The stop reception portion 2 receives, from the operation portion 101, a command (hereinafter, referred to as the stop command) for stopping the start of the above fluid pressure actuators 61 and 62.

In response to the start reception portion 1 receiving the start command, the forward rotation control portion 3 gives a forward rotation signal for rotating in a forward direction to the brushless motor 30. In response to the stop reception portion 2 receiving the stop command, the reverse rotation control portion 4 gives a reverse rotation signal corresponding to a reverse direction to the brushless motor 30. The forward rotation control portion 3 is an example of a first rotation control portion, and the reverse rotation control portion 4 is an example of a second rotation control portion.

The blocking control portion 5 controls the bypass valve 42 to come into the blocking state in response to the start reception portion 1 receiving the start command. The opening control portion 6 controls the bypass valve 42 to come into the opening state in response to the stop reception portion 2 receiving the stop command. The output control portion 7 specifies the operation of the fluid pressure actuators 61 and 62 based on the command given from the operation portion 101, and controls the direction control valves 63 and 64 to execute the specified operation.

Figure 3:
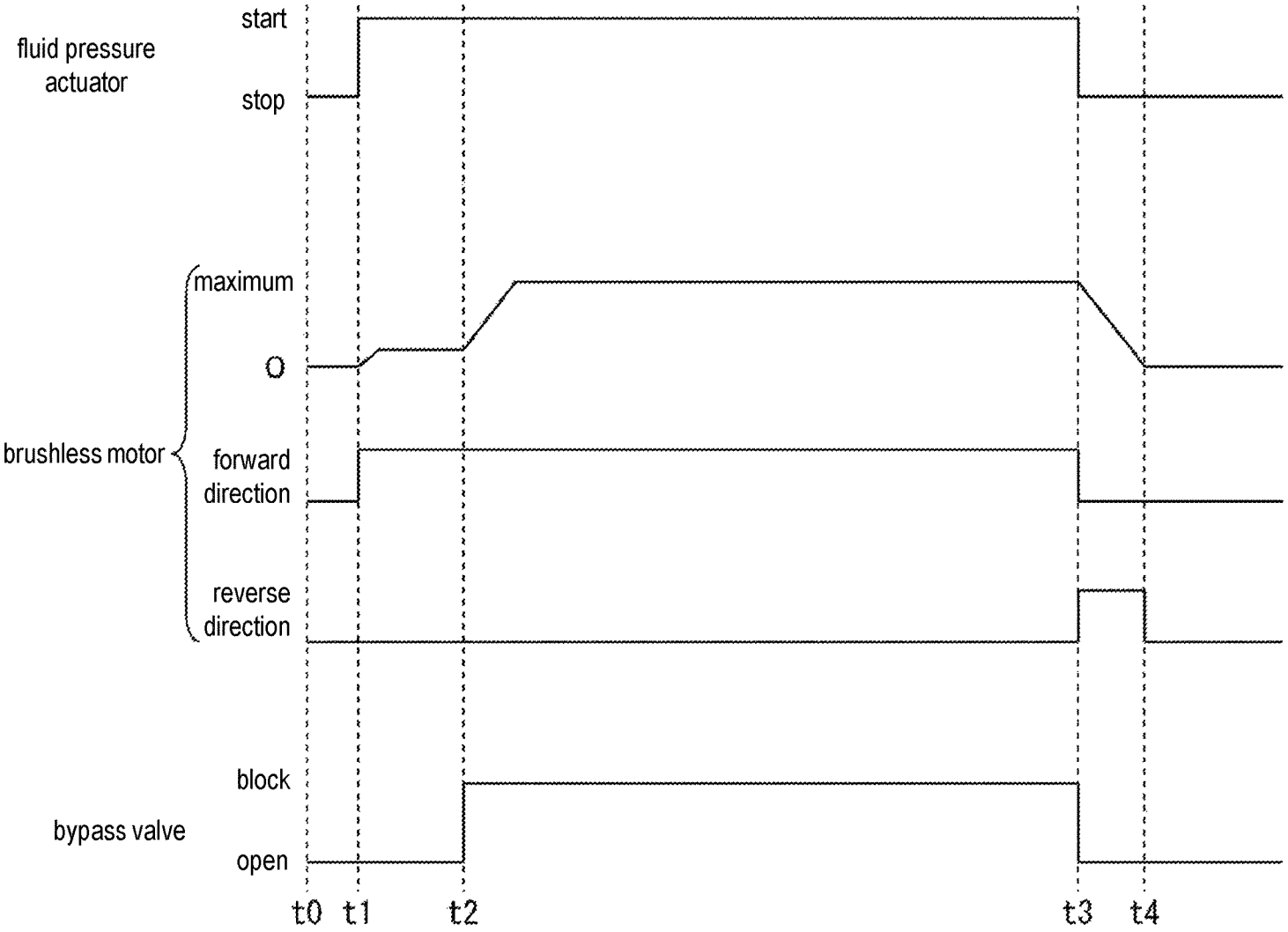
FIG. 3 is a time chart for illustrating one example of operation of the control portion.

FIG. 3 is a time chart for illustrating one example of the operation of the control portion 70. As shown in FIG. 3, at an initial time point t0, the start of the fluid pressure actuators 61 and 62 is stopped, the rotation of the brushless motor 30 is stopped, and the bypass valve 42 is in the opening state.

At a time point t1, the user operates the operation portion 101 to instruct desired start of the fluid pressure actuators 61 and 62, and thereby the start command is given to the start reception portion 1. In this case, the forward rotation control portion 3 gives the forward rotation signal to the brushless motor 30 so that the brushless motor 30 rotates at a predetermined low rotation speed (for example, a constant speed of 500 rpm or less). After the speed of the brushless motor 30 reaches the low rotation speed, the low rotation speed is maintained until a time point t2.

At the time point t2, the blocking control portion 5 controls the bypass valve 42 to come into the blocking state. The duration from the time point t1 to the time point t2 is, for example, 0.1 second or more and 0.3 second or less. In addition, at the time point t2, the forward rotation control portion 3 further gives the forward rotation signal to the brushless motor 30. After the rotation speed of the brushless motor 30 reaches a maximum speed, the maximum speed is maintained until an instruction to stop the start of the fluid pressure actuators 61 and 62 is given.

At a time point t3, the user operates the operation portion 101 to instruct desired stop of the start of the fluid pressure actuators 61 and 62, and thereby the stop command is given to the stop reception portion 2. In this case, the opening control portion 6 controls the bypass valve 42 to come into the opening state. In addition, the reverse rotation control portion 4 gives the reverse rotation signal to the brushless motor 30 at the time point t3. Accordingly, the rotation speed of the brushless motor 30 in the forward direction decreases, and the rotation speed becomes zero at a time point t4. At the time point t4, the reverse rotation control portion 4 stops the control of the brushless motor 30.

(3) Hydraulic Device Control Process

Figure 4:
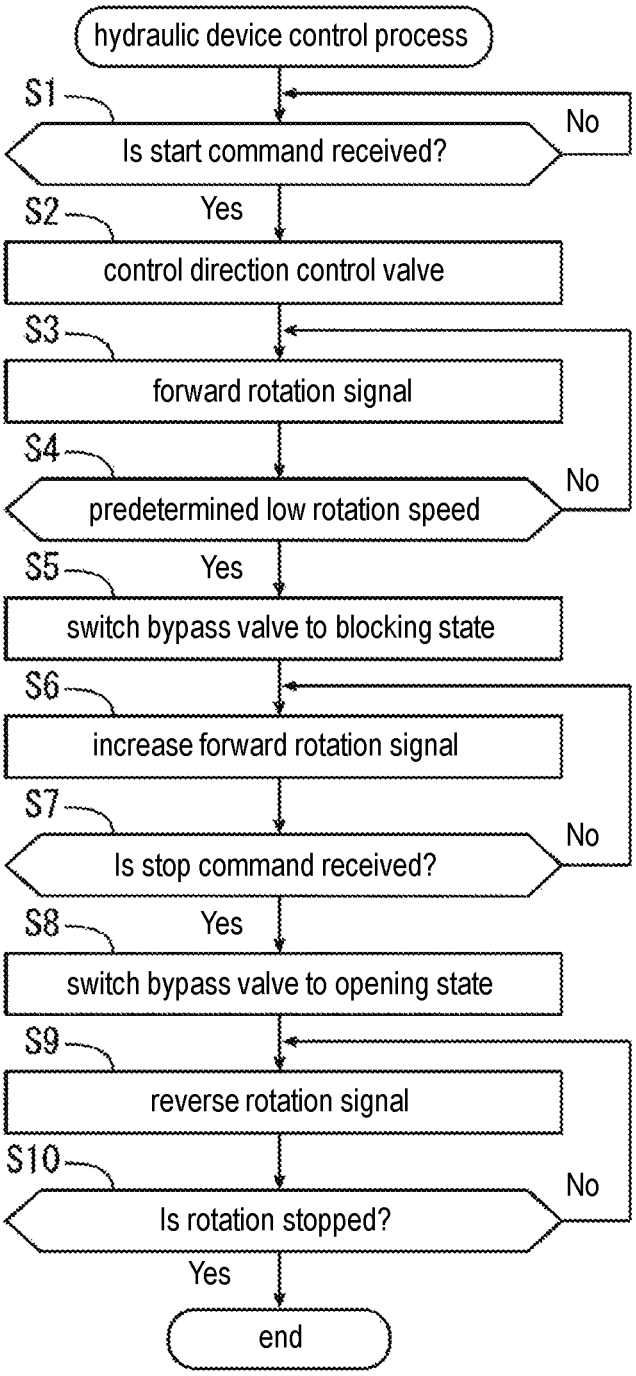
FIG. 4 is a flowchart showing an algorithm of a hydraulic device control process performed by a hydraulic device control program.

FIG. 4 is a flowchart showing an algorithm of a hydraulic device control process performed by the hydraulic device control program. The hydraulic device control process is described below using the control portion 70 in FIG. 2 and the flowchart of FIG. 4. Furthermore, at an initial state, the start of the fluid pressure actuators 61 and 62 is stopped, the rotation of the brushless motor 30 is stopped, and the bypass valve 42 is in the opening state.

First, the start reception portion 1 determines whether the start command is received from the operation portion 101 (step S1). If the start command is not received, the start reception portion 1 waits until the start command is received. If the start command is received, the output control portion 7 controls the direction control valves 63 and 64 to be capable of executing the operation corresponding to the received start command (step S2). In addition, the forward rotation control portion 3 gives the forward rotation signal to the brushless motor 30 (step S3).

Next, the blocking control portion 5 determines whether the rotation speed of the brushless motor 30 reaches the predetermined low rotation speed (step S4). If the rotation speed of the brushless motor 30 does not reach the low rotation speed, the blocking control portion 5 returns to step S3. Steps S3 and S4 are repeated until the rotation speed of the brushless motor 30 reaches the low rotation speed. Furthermore, if the rotation speed of the brushless motor 30 reaches the low rotation speed, the forward rotation control portion 3 maintains the rotation speed of the brushless motor 30 at the low rotation speed in step S3.

In this example, the blocking control portion 5 determines that the rotation speed of the brushless motor 30 reaches the low rotation speed after a predetermined time (for example, 0.1 second or more and 0.3 second or less) has elapsed since the start command is received in step S1. Therefore, in step S4, the blocking control portion 5 determines whether the predetermined time has elapsed since the start command is received in step S1, and if the time has not elapse, the start reception portion 1 waits until the time has elapses.

When the rotation speed of the brushless motor 30 reaches the predetermined low rotation speed in step S4 (when the predetermined time has elapsed), the blocking control portion 5 switches the bypass valve 42 to the blocking state (step S5). In addition, the forward rotation control portion 3 increases the forward rotation signals of the brushless motor 30 (step S6). Thereby, the rotation speed of the brushless motor 30 increases.

Thereafter, the stop reception portion 2 determines whether the stop command is received from the operation portion 101 (step S7). If the stop command is not received, the stop reception portion 2 returns to step S6. Steps S6 and S7 are repeated until the stop command is received. Furthermore, when the rotation speed of the brushless motor 30 reaches the maximum speed, the forward rotation control portion 3 maintains the rotation speed of the brushless motor 30 at the maximum speed in step S6.

If the stop command is received in step S7, the opening control portion 6 switches the bypass valve 42 to the opening state (step S8). In addition, the reverse rotation control portion 4 gives the reverse rotation signal to the brushless motor 30 (step S9). Thereby, the rotation speed of the brushless motor 30 decreases. Next, the reverse rotation control portion 4 determines whether the rotation speed of the brushless motor 30 becomes 0, that is, whether the rotation of the brushless motor 30 is stopped (step S10).

If the rotation of the brushless motor 30 is not stopped, the reverse rotation control portion 4 returns to step S9. Steps S9 and S10 are repeated until the rotation of the brushless motor 30 is stopped. If the rotation of the brushless motor 30 is stopped, the reverse rotation control portion 4 ends the hydraulic device control process.

(4) Effects

In the hydraulic device 100 according to the embodiment, the working fluid stored in the fluid storage portion 10 is supplied to the power output portion 60 by the fluid supply portion 20. The fluid supply portion 20 is driven by the brushless motor 30. According to this configuration, since the brushless motor 30 is used as the electric motor, a period of endurance of the electric motor is not limited by life of the brush. Therefore, durability of the hydraulic device 100 is improved.

In addition, the bypass flow path portion 40 is arranged which can be switched between the opening state of supplying the working fluid from the fluid supply portion 20 to the fluid storage portion 10 and the blocking state of blocking the fluid supply portion 20 from the fluid storage portion 10. When the start command of the power output portion 60 is received by the start reception portion 1, the forward rotation signal is given from the forward rotation control portion 3 to the brushless motor 30, and thereby the brushless motor 30 is rotated in the forward direction.

In the initial state, since the bypass flow path portion 40 is in the opening state, the fluid from the fluid supply portion 20 is returned to the fluid storage portion 10 through the bypass flow path portion 40 until the rotation speed of the brushless motor 30 increases to the predetermined low rotation speed. Backflow of the working fluid from the power output portion 60 to the bypass flow path portion 40 is prevented by the backflow prevention valve 50. Here, since the rotation speed of the brushless motor 30 is low, a flow rate of the fluid passing through the bypass flow path portion 40 is small, and thus generation of fluid noise can be prevented.

After the rotation speed of the brushless motor 30 increases to the low rotation speed, the bypass flow path portion 40 is switched by the bypass control portion 5 from the opening state to the blocking state. In this case, when the power output portion 60 is started, since the working fluid is supplied to the power output portion 60 after the brushless motor 30 is rotated at a sufficient rotation speed, failure of the start of the brushless motor 30 due to insufficient torque can be avoided. Therefore, it may not be necessary to use a motor having a great inverter capacity corresponding to a high starting torque as the brushless motor 30, and a motor having a small inverter capacity can be used.

In addition, since the failure of the start of the brushless motor 30 due to insufficient torque is avoided, the sensorless-type brushless motor 30 having no position sensor can be used as the brushless motor 30. In this case, the brushless motor 30 and the fluid supply portion 20 can be connected with fewer wires.

When the stop command of the power output portion 60 is received by the stop reception portion 2, the bypass flow path portion 40 is switched by the opening control portion 6 from the blocking state to the opening state. Therefore, occurrence of pressurization in a pipe 102 connecting the fluid supply portion 20 and the power output portion 60 is prevented. Thereby, burden of the pipe 102 is reduced.

In addition, when the stop command of the power output portion 60 is received by the stop reception portion 2, the reverse rotation signal is given to the brushless motor 30 by the reverse rotation control portion 4 to stop the rotation of the brushless motor 30. In this case, after the power output portion 60 is stopped, the rotation of the brushless motor 30 is stopped in a shorter time. Thereby, the occurrence of the pressurization in the pipe 102 can be more reliably prevented. As a result of these configurations, the hydraulic device 100 can be operated with high reliability while the durability of the hydraulic device 100 is improved.

(5) Other Embodiments (a) In the above embodiment, a first control to switch the bypass flow path portion 40 from the opening state to the blocking state after the brushless motor 30 is started and a second control to switch the bypass flow path portion 40 from the blocking state to the opening state when the brushless motor 30 is stopped are both performed, but the embodiment is not limited hereto. It may be that only one of the first control and the second control is performed and the other is not performed.

(b) In the above embodiment, the reverse rotation signal is given to the brushless motor 30 when the power output portion 60 is stopped, but the embodiment is not limited hereto. When the power output portion 60 is stopped, the brushless motor 30 may be naturally stopped without giving the reverse rotation signal to the brushless motor 30.

(c) In the above embodiment, the power output portion 60 includes a plurality of the fluid pressure actuators 61 and 62, but the embodiment is not limited hereto. The power output portion 60 may include one fluid pressure actuator.

(6) Aspects (Item 1) A hydraulic device according to one aspect may include:

a fluid storage portion which stores working fluid;

a power output portion which outputs power from the working fluid;

a fluid supply portion which supplies the working fluid stored in the fluid storage portion to the power output portion;

a brushless motor which drives the fluid supply portion;

a bypass flow path portion which can switched be between a first state of supplying the working fluid from the fluid supply portion to the fluid storage portion and a second state of blocking the fluid supply portion from the fluid storage portion;

a control portion which performs at least one of a control to switch the bypass flow path portion from the first state to the second state after the brushless motor is started and a control to switch the bypass flow path portion from the second state to the first state when the brushless motor is stopped; and a backflow prevention valve which prevents backflow of the working fluid from the power output portion to the bypass flow path portion.

In the hydraulic device, the working fluid stored in the fluid storage portion is supplied by the fluid supply portion to the power output portion which outputs the power from the working fluid. The fluid supply portion is driven by the brushless motor. The bypass flow path portion is arranged which can be switched between the first state of supplying the working fluid from the fluid supply portion to the fluid storage portion and the second state of blocking the fluid supply portion from the fluid storage portion. At least one of the control to switch the bypass flow path portion from the first state to the second state after the brushless motor is started and the control to switch the bypass flow path portion from the second state to the first state when the brushless motor 30 is stopped is performed. The backflow of the working fluid from the power output portion to the bypass flow path portion is prevented by the backflow prevention valve.

According to this configuration, a brushless motor is used as the electric motor. Therefore, the period of endurance of the electric motor is not limited by the life of the brush. Therefore, the durability of the hydraulic device is improved.

In addition, when the bypass flow path is switched from the first state to the second state after the brushless motor is started, high torque is not applied to the electric motor immediately after the brushless motor is started. Thereby, the brushless motor can start the rotation smoothly. In addition, after the brushless motor starts the rotation, the working fluid stored in the fluid storage portion is supplied to the power output portion by the fluid supply portion. Therefore, failure of start of the brushless motor due to insufficient torque can be avoided.

On the other hand, when the bypass flow path portion is switched from the second state to the first state when the brushless motor is stopped, the working fluid supplied by the fluid supply portion is returned to the fluid storage portion through the bypass flow path portion. In this case, since pressurization does not occur in the pipe connecting the fluid supply portion and the power output portion, burden on the pipe is reduced.

Therefore, reliability of the hydraulic device is improved by performing at least one of the above controls of the bypass flow path portion. As a result, the hydraulic device can be operated with high reliability while the durability of the hydraulic device is improved.

(Item 2) In the hydraulic device according to item 1, the control portion may include:

a start reception portion which receives a start command of the power output portion;

a first rotation control portion which gives the brushless motor a first rotation signal for rotating the brushless motor in a predetermined direction in response to reception of the start command by the start reception portion; and a blocking control portion which switches the bypass flow path portion from the first state to the second state after a rotation speed of the brushless motor has increased to a predetermined value.

In this case, when the power output portion is started, the working fluid is supplied to the power output portion after the brushless motor is rotated at a sufficient rotation speed. Therefore, the failure of the start of the brushless motor due to insufficient torque can be avoided more reliably.

(Item 3) In the hydraulic device according to item 2, the brushless motor may be a sensorless-type brushless motor having no position sensor.

In this case, since the failure of the start of the brushless motor due to insufficient torque is avoided, the sensorless-type brushless motor having no position sensor can be used as the brushless motor. Thereby, the brushless motor and the fluid supply portion can be connected with fewer wires. As a result, the durability and reliability of the hydraulic device can be further improved.

(Item 4) In the hydraulic device according to any one of items 1 to 3, the control portion may include:

a stop reception portion which receives a stop command of the power output portion; and an opening control portion which switches the bypass flow path portion from the second state to the first state in response to reception of the stop command by the stop reception portion.

In this case, when the power output portion is stopped, the bypass flow path portion is switched from the second state to the first state. Thereby, the occurrence of the pressurization in the pipe which connects the fluid supply portion and the power output portion can be prevented more reliably.

(Item 5) In the hydraulic device according to item 4, the control portion may further include a second rotation control portion which gives the brushless motor a second rotation signal corresponding to a rotation direction opposite to the rotation direction so as to stop the rotation of the brushless motor, in response to reception of the stop command by the stop reception portion.

In this case, after the power output portion is stopped, the rotation of the brushless motor is stopped in a shorter time. Thereby, the occurrence of the pressurization in the pipe which connects the fluid supply portion and the power output portion can be prevented more reliably.

(Item 6) A control method of hydraulic device according to another aspect may include:

a step in which working fluid stored in a fluid storage portion is supplied by a fluid supply portion to a power output portion which outputs power from the working fluid;

a step in which the fluid supply portion is driven by a brushless motor;

a step in which a bypass flow path portion is switched between a first state of supplying the working fluid from the fluid supply portion to the fluid storage portion and a second state of blocking the fluid supply portion from the fluid storage portion; and a step in which backflow of the working fluid from the power output portion to the bypass flow path portion is prevented by a backflow prevention valve; wherein the step in which the bypass flow path portion is switched includes at least one of switching the bypass flow path portion from the first state to the second state after the brushless motor is started and switching the bypass flow path portion from the second state to the first state when the brushless motor is stopped.

According to the control method of hydraulic device, a brushless motor is used as the electric motor. Therefore, a period of endurance of the electric motor is not limited by the life of the brush. Therefore, the durability of the hydraulic device is improved. In addition, at least one of the control to switch the bypass flow path portion from the first state to the second state after the brushless motor is started and the control to switch the bypass flow path portion from the second state to the first state when the brushless motor is stopped is performed. Thereby, the reliability of the hydraulic device is improved. As a result, the hydraulic device can be operated with high reliability while the durability of the hydraulic device is improved.

What is claimed is:

1. A hydraulic device, comprising:

a fluid storage portion which stores working fluid;

a power output portion which outputs power from the working fluid;

a fluid supply portion which supplies the working fluid stored in the fluid storage portion to the power output portion;

a brushless motor which drives the fluid supply portion;

a bypass flow path portion capable of being switched between a first state of supplying the working fluid from the fluid supply portion to the fluid storage portion and a second state of blocking the fluid supply portion from the fluid storage portion;

a control portion which performs at least one of a control to switch the bypass flow path portion from the first state to the second state after the brushless motor is started and a control to switch the bypass flow path portion from the second state to the first state when the brushless motor is stopped; and a backflow prevention valve which prevents backflow of the working fluid from the power output portion to the bypass flow path portion, wherein the control portion comprises:

a start reception portion which receives a start command of the power output portion;

a first rotation control portion which gives the brushless motor a first rotation signal for rotating the brushless motor in a predetermined direction in response to reception of the start command by the start reception portion; and a blocking control portion which switches the bypass flow path portion from the first state to the second state after a rotation speed of the brushless motor has increased to a predetermined value.

2. The hydraulic device according to claim 1, wherein the brushless motor is a sensorless-type brushless motor having no position sensor.

3. The hydraulic device according to claim 2, wherein the control portion comprises:

a stop reception portion which receives a stop command of the power output portion; and an opening control portion which switches the bypass flow path portion from the second state to the first state in response to reception of the stop command by the stop reception portion.

4. The hydraulic device according to claim 3, wherein the control portion further comprises a second rotation control portion which gives the brushless motor a second rotation signal corresponding to a rotation direction opposite to the rotation direction so as to stop the rotation of the brushless motor, in response to reception of the stop command by the stop reception portion.

5. The hydraulic device according to claim 1, wherein the control portion comprises:

a stop reception portion which receives a stop command of the power output portion; and an opening control portion which switches the bypass flow path portion from the second state to the first state in response to reception of the stop command by the stop reception portion.

6. The hydraulic device according to claim 5, wherein the control portion further comprises a second rotation control portion which gives the brushless motor a second rotation signal corresponding to a rotation direction opposite to the rotation direction so as to stop the rotation of the brushless motor, in response to reception of the stop command by the stop reception portion.

7. A hydraulic device, comprising:

a fluid storage portion which stores working fluid;

a power output portion which outputs power from the working fluid;

a fluid supply portion which supplies the working fluid stored in the fluid storage portion to the power output portion;

a brushless motor which drives the fluid supply portion;

a bypass flow path portion capable of being switched between a first state of supplying the working fluid from the fluid supply portion to the fluid storage portion and a second state of blocking the fluid supply portion from the fluid storage portion;

a control portion which performs at least one of a control to switch the bypass flow path portion from the first state to the second state after the brushless motor is started and a control to switch the bypass flow path portion from the second state to the first state when the brushless motor is stopped; and a backflow prevention valve which prevents backflow of the working fluid from the power output portion to the bypass flow path portion, wherein the control portion comprises:

a stop reception portion which receives a stop command of the power output portion; and an opening control portion which switches the bypass flow path portion from the second state to the first state in response to reception of the stop command by the stop reception portion.

8. The hydraulic device according to claim 7, wherein the control portion further comprises a second rotation control portion which gives the brushless motor a second rotation signal corresponding to a rotation direction opposite to the rotation direction so as to stop the rotation of the brushless motor, in response to reception of the stop command by the stop reception portion.

9. A control method of a hydraulic device, comprising:

a step in which working fluid stored in a fluid storage portion is supplied by a fluid supply portion to a power output portion which outputs power from the working fluid;

a step in which the fluid supply portion is driven by a brushless motor;

a step in which a bypass flow path portion is switched between a first state of supplying the working fluid from the fluid supply portion to the fluid storage portion and a second state of blocking the fluid supply portion from the fluid storage portion; and a step in which backflow of the working fluid from the power output portion to the bypass flow path portion is prevented by a backflow prevention valve; wherein the step in which the bypass flow path portion is switched comprises at least one of switching the bypass flow path portion from the first state to the second state after the brushless motor is started and switching the bypass flow path portion from the second state to the first state when the brushless motor is stopped, wherein the control method of the hydraulic device further comprises a step in which a start command of the power output portion is received by a start reception portion;

a step in which a first rotation signal for rotating the brushless motor in a predetermined direction is given to the brushless motor by a first rotation control portion in response to reception of the start command by the start reception portion; and a step in which the bypass flow path portion is switched by a blocking control portion from the first state to the second state after a rotation speed of the brushless motor has increased to a predetermined value.

10. A control method of a hydraulic device, comprising:

a step in which working fluid stored in a fluid storage portion is supplied by a fluid supply portion to a power output portion which outputs power from the working fluid;

a step in which the fluid supply portion is driven by a brushless motor;

a step in which a bypass flow path portion is switched between a first state of supplying the working fluid from the fluid supply portion to the fluid storage portion and a second state of blocking the fluid supply portion from the fluid storage portion; and a step in which backflow of the working fluid from the power output portion to the bypass flow path portion is prevented by a backflow prevention valve; wherein the step in which the bypass flow path portion is switched comprises at least one of switching the bypass flow path portion from the first state to the second state after the brushless motor is started and switching the bypass flow path portion from the second state to the first state when the brushless motor is stopped, wherein the control method of the hydraulic device further comprises a step in which a stop command of the power output portion is received by a stop reception portion; and a step in which the bypass flow path portion is switched by an opening control portion from the second state to the first state in response to reception of the stop command by the stop reception portion.

* * * * *